US010633828B2

(12) United States Patent
Joo

(10) Patent No.: US 10,633,828 B2
(45) Date of Patent: Apr. 28, 2020

(54) HYDRAULIC CONTROL DEVICE AND HYDRAULIC CONTROL METHOD FOR CONSTRUCTION MACHINE

(71) Applicant: DOOSAN INFRACORE CO., LTD., Incheon (KR)

(72) Inventor: Choon-shik Joo, Incheon (KR)

(73) Assignee: DOOSAN INFRACORE CO., LTD., Incheon (KR)

( * ) Notice: Subject to any disclaimer, the term of this patent is extended or adjusted under 35 U.S.C. 154(b) by 220 days.

(21) Appl. No.: 15/781,313

(22) PCT Filed: Jun. 1, 2016

(86) PCT No.: PCT/KR2016/005791
§ 371 (c)(1),
(2) Date: Jun. 4, 2018

(87) PCT Pub. No.: WO2017/094985
PCT Pub. Date: Jun. 8, 2017

(65) Prior Publication Data

US 2018/0363271 A1 Dec. 20, 2018

(30) Foreign Application Priority Data

Dec. 4, 2015 (KR) ..... 10-2015-0172641

(51) Int. Cl.
*E02F 9/22* (2006.01)
*E02F 9/24* (2006.01)
(Continued)

(52) U.S. Cl.
CPC ..... *E02F 9/226* (2013.01); *E02F 9/20* (2013.01); *E02F 9/22* (2013.01); *E02F 9/2228* (2013.01);
(Continued)

(58) Field of Classification Search
CPC ... E02F 9/20; E02F 9/22; E02F 9/2217; E02F 9/2228; E02F 9/2235; E02F 9/226;
(Continued)

(56) References Cited

U.S. PATENT DOCUMENTS 9,598,842 B2 3/2017 Imura et al.
9,618,019 B2 4/2017 Jung et al.
(Continued)

FOREIGN PATENT DOCUMENTS

KR 20120080645 7/2012
KR 20140063721 5/2014
(Continued)

OTHER PUBLICATIONS

Search Report for International Patent Application No. PCT/KR2016/005791 and English translation of same dated Sep. 1, 2016.
(Continued)

*Primary Examiner* — Tyler J Lee
(74) *Attorney, Agent, or Firm* — K&L Gates LLP

(57) ABSTRACT

A hydraulic control apparatus for construction machinery, includes an accumulator to accumulate a high-pressure hydraulic oil discharged from a boom cylinder for driving a boom of the construction machinery, a hydraulic pump connected to the accumulator and driven by the high-pressure hydraulic oil, a pressure sensor configured to detect a pressure of the accumulator, and a control unit connected to the accumulator and the hydraulic motor and configured to control operations of the accumulator and the hydraulic motor, and having a determiner that receives a pressure value of the accumulator and number of revolution of the hydraulic motor to determine whether or not the hydraulic motor fails when the hydraulic oil accumulated in the accumulator is supplied to the hydraulic motor.

17 Claims, 5 Drawing Sheets

(51) Int. Cl.
*E02F 9/26* (2006.01)
*E02F 9/20* (2006.01)

(52) U.S. Cl.
CPC ..... *E02F 9/2285* (2013.01); *E02F 9/24* (2013.01); *E02F 9/26* (2013.01)

(58) Field of Classification Search
CPC ..... E02F 9/2285; E02F 9/2296; E02F 9/24; E02F 9/26
See application file for complete search history.

(56) References Cited

U.S. PATENT DOCUMENTS

2008/0163750 A1* 7/2008 Yuan ..... F15B 9/09 91/402
2012/0131913 A1* 5/2012 Yoshino ..... E02F 9/2235 60/459
2015/0107234 A1* 4/2015 Ueda ..... E02F 9/2296 60/329
2015/0107236 A1* 4/2015 Udagawa ..... F15B 7/006 60/430
2015/0218780 A1* 8/2015 Hijikata ..... E02F 9/2095 701/50
2015/0247513 A1* 9/2015 Morris ..... E02F 9/2066 701/50

FOREIGN PATENT DOCUMENTS

KR 1020140135690 11/2014
KR 20150110597 10/2015
WO 2014208796 12/2014

OTHER PUBLICATIONS

Written Opinion for International Patent Application No. PCT/KR2016/005791 dated Sep. 1, 2016.

* cited by examiner

HYDRAULIC CONTROL DEVICE AND HYDRAULIC CONTROL METHOD FOR CONSTRUCTION MACHINE

CROSS REFERENCE TO RELATED APPLICATIONS

The present application is a National Stage of International Application No. PCT/KR2016/005791, filed on Jun. 1, 2016, which claims priority to Korean Patent Application No. 10-2015-0172641, filed on Dec. 4, 2015, the entire contents of each of which are being incorporated herein by reference.

TECHNICAL FIELD

The present invention relates to a hydraulic control apparatus and a hydraulic control method for construction machinery, more particularly, to a hydraulic control apparatus including a regeneration device for regenerating boom energy in construction machinery and a hydraulic control method.

BACKGROUND ART

Construction machinery may raise and lower a front work apparatus using a hydraulic cylinder to. For example, an engine power may be used to drive a hydraulic pump, and a hydraulic oil discharged from the hydraulic pump may be supplied to a boom cylinder through a main control valve to generate stoke of the boom cylinder, thereby raising a boom. On the other hand, when the boom is lowered, the hydraulic oil from the boom cylinder may be drained to a drain tank through the main control valve due to gravity of the front work apparatus. During the boom down operation, potential energy of the front work apparatus may not be effectively utilized. Accordingly, a new technique of regenerating the potential energy may have been developed.

Especially, even if a regeneration device such as a hydraulic motor for regenerating the boom energy has abnormality and thus cannot operate normally, the boom cylinder should be controlled to operate normally.

DISCLOSURE OF THE INVENTION

Problems to be Solved

An object of the present invention provides a hydraulic control apparatus for construction machinery capable of effectively regenerating boom energy of the construction machinery.

Another object of the present invention provides a hydraulic control method using the above hydraulic control apparatus for construction machinery.

Means to Solve the Problems

According to example embodiments, a hydraulic control apparatus for construction machinery, includes an accumulator to accumulate a high-pressure hydraulic oil discharged from a boom cylinder for driving a boom of the construction machinery, a hydraulic pump connected to the accumulator and driven by the high-pressure hydraulic oil, a pressure sensor configured to detect a pressure of the accumulator, and a control unit connected to the accumulator and the hydraulic motor and configured to control operations of the accumulator and the hydraulic motor, and having a determiner that receives a pressure value of the accumulator and number of revolution of the hydraulic motor to determine whether or not the hydraulic motor fails when the hydraulic oil accumulated in the accumulator is supplied to the hydraulic motor.

In example embodiments, the determiner may include a first calculator to calculate a volume change of the accumulator from the pressure value of the accumulator, a second calculator to calculate a flow rate of the hydraulic oil flowing through the hydraulic motor from the number of revolution of the hydraulic motor, and a compares to compare the volume change and the flow rate to determine a failure in the hydraulic motor and output a control signal.

In example embodiments, the hydraulic motor may include a variable displacement hydraulic motor.

In example embodiments, when it is determined that the hydraulic motor fails, the control unit may control such that the hydraulic oil discharged from the boom cylinder is blocked from being supplied to the hydraulic motor and a pilot pressure from a manipulation portion is supplied to a main control valve.

In example embodiments, the hydraulic oil discharged from a boom head chamber of the boom cylinder may be drained to a drain tank through the main control valve.

In example embodiments, when it is determined that the hydraulic motor operates normally, the control unit may control such that a pilot pressure from a manipulation portion is blocked from being transferred to a main control valve.

In example embodiments, the hydraulic control apparatus for construction machinery may further include a bypass valve provided between the manipulation portion and the main control valve to block the pilot pressure from being transferred to the main control valve.

In example embodiments, the accumulator and the hydraulic motor may be connected to a boom head chamber of the boom cylinder through a hydraulic regeneration line.

In example embodiments, the hydraulic control apparatus for construction machinery may further include a regeneration valve unit installed in the hydraulic regeneration line, and the regeneration valve unit may include a discharge amount control valve to control an amount of the hydraulic oil flowing through the hydraulic regeneration line.

In example embodiments, the hydraulic motor may be connected to a drive axis of an engine to provide a rotational force to a hydraulic pump that supplies the hydraulic oil to the boom cylinder.

According to example embodiments, in a hydraulic control method for construction machinery, a hydraulic oil accumulated in an accumulator is supplied to a hydraulic motor so as to regenerate energy of the hydraulic oil discharged from a boom cylinder of the construction machinery. A volume change of the accumulator and a flow rate of the hydraulic oil flowing through the hydraulic motor are calculated. The volume change and the flow rate are compared to determine whether or not the hydraulic motor fails.

In example embodiments, calculating the volume change of the accumulator and the flow rate of the hydraulic oil flowing through the hydraulic motor may include detecting a pressure of the accumulator to calculate the volume change of the accumulator, and calculating the flow rate of the hydraulic oil flowing through the hydraulic motor from number of revolution of the hydraulic motor.

In example embodiments, the hydraulic control method for construction machinery may further include when it is determined that the hydraulic motor fails, blocking the hydraulic oil discharged from the boom cylinder from being supplied to the hydraulic motor and supplying a pilot pressure from a manipulation portion to a main control valve.

In example embodiments, the hydraulic control method for construction machinery may further include draining the hydraulic oil discharged from a boom head chamber of the boom cylinder to a drain tank through the main control valve.

In example embodiments, the hydraulic control method for construction machinery may further include when it is determined that the hydraulic motor operates normally, blocking a pilot pressure from a manipulation portion from being transferred to a main control valve.

In example embodiments, the hydraulic control method for construction machinery may further include supplying the hydraulic oil from a boom head chamber of the boom cylinder to the accumulator or the hydraulic motor through a hydraulic regeneration line.

In example embodiments, the hydraulic motor may be connected to a drive axis of an engine to provide a rotational force to a hydraulic pump that supplies the hydraulic oil to the boom cylinder.

Effects of the Invention

According to example embodiments, in a hydraulic control apparatus and a hydraulic control method for construction machinery, a calculated volume change due to a pressure change in an accumulator and a theoretical flow rate value of a hydraulic motor may be calculated to determine whether or not the hydraulic motor fails.

Accordingly, because an extra swash plate sensor for detecting a failure in the hydraulic motor is not needed, a design modification of the hydraulic motor may not be required, and whether or not the hydraulic motor fails may be determined using software calculation. When it is determined that the hydraulic motor fails, a boom energy regeneration device may discontinue to operate and an operator may be notified of an alarm signal for rapid repairs.

However, the effect of the invention may not be limited thereto, and may be expanded without being deviated from the concept and the scope of the present invention.

BEST MODE FOR CARRYING OUT THE INVENTION

Figure 1:
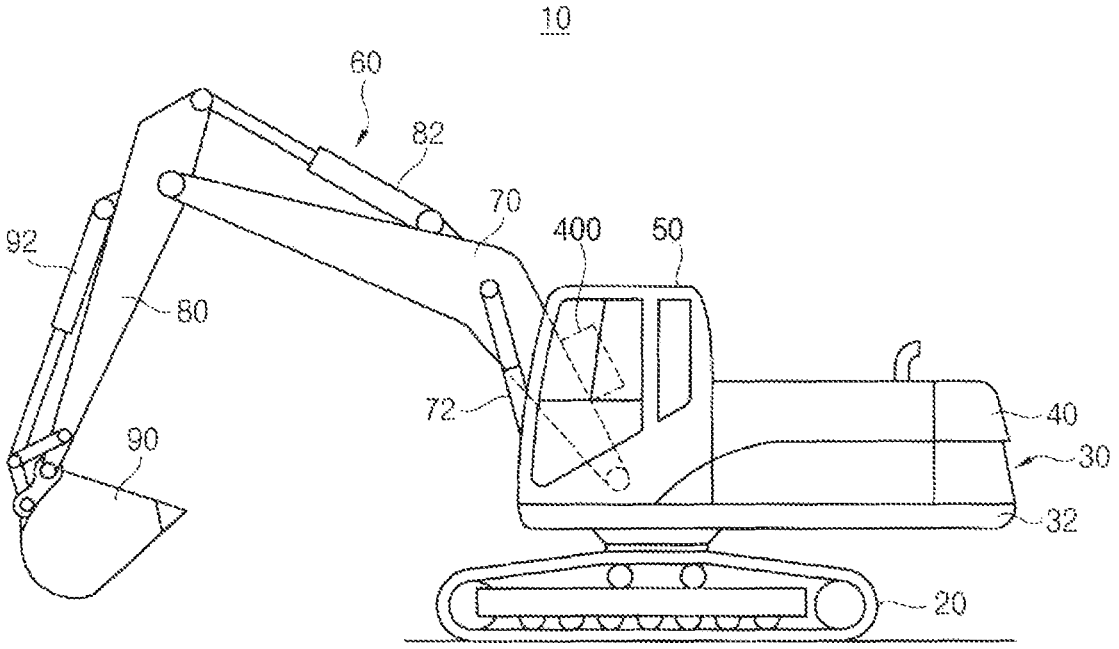
FIG. 1 is a side view illustrating construction machinery in accordance with example embodiments.

Various example embodiments will be described more fully hereinafter with reference to the accompanying drawings, in which example embodiments are shown. Example embodiments may, however, be embodied in many different forms and should not be construed as limited to example embodiments set forth herein. Rather, these example embodiments are provided so that this disclosure will be thorough and complete, and will fully convey the scope of example embodiments to those skilled in the art. In the drawings, the sizes and relative sizes of components or elements may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element or layer is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of example embodiments. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, preferable embodiments of the present invention will be explained in detail with reference to the accompanying drawings. Like numerals refer to like elements throughout example embodiments, and any further repetitive explanation concerning the similar elements will be omitted.

Figure 2:
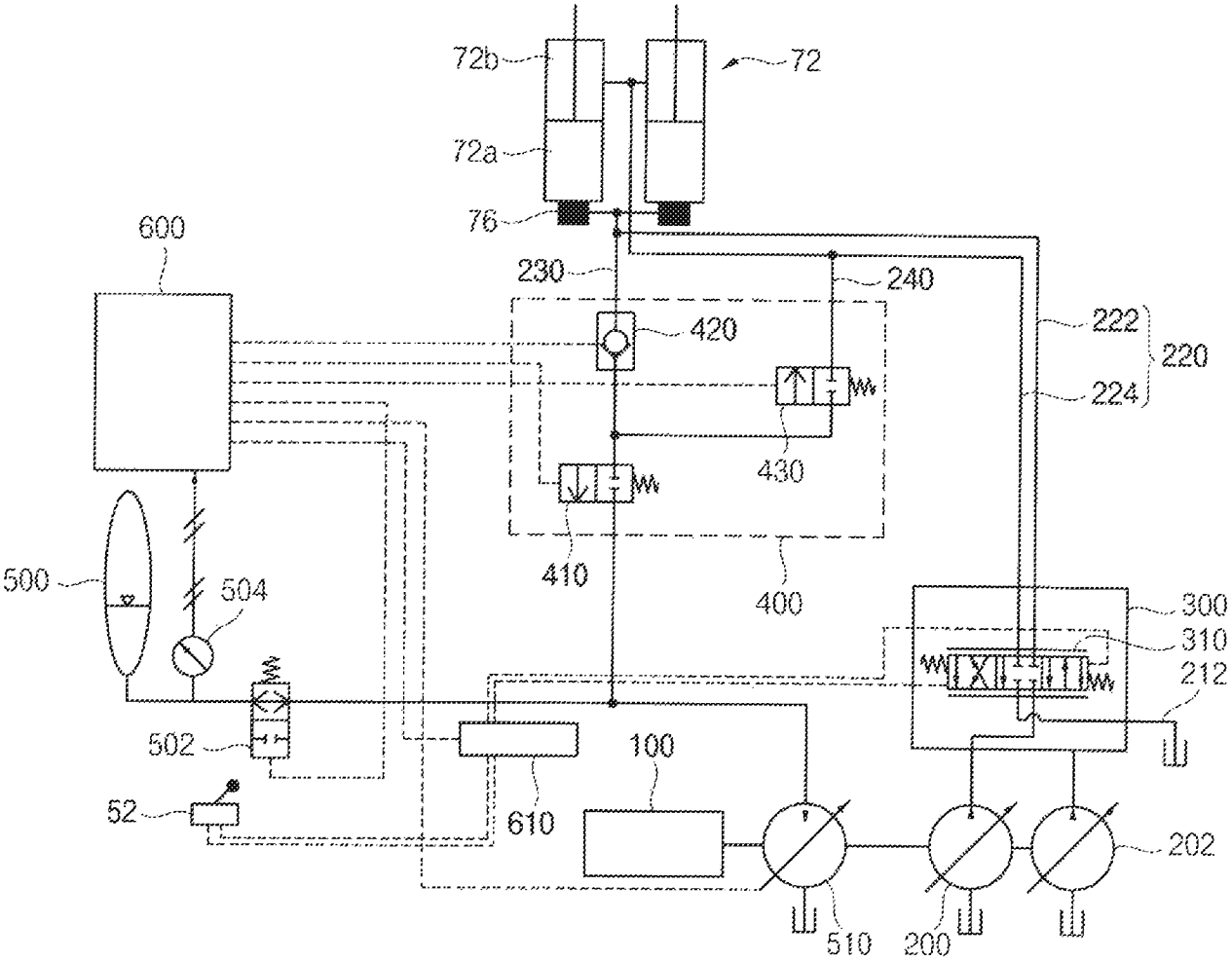
FIG. 2 is a hydraulic circuit diagram illustrating a hydraulic system for construction machinery in accordance with example embodiments.
Figure 3:
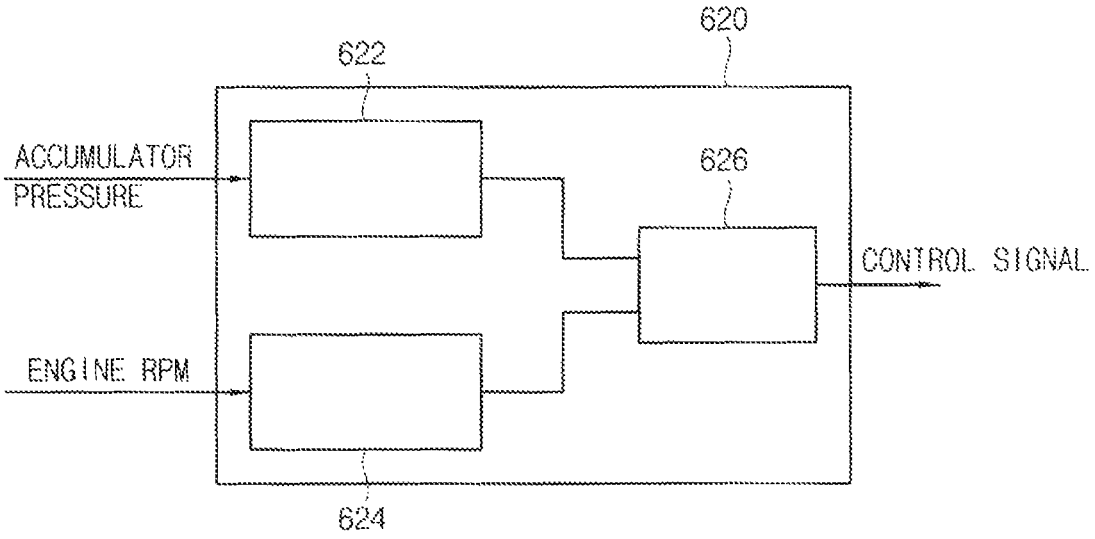
FIG. 3 is a block diagram illustrating a determiner configured to determine a failure in a regeneration device of the hydraulic system in FIG. 2.

FIG. 1 is a side view illustrating construction machinery in accordance with example embodiments. FIG. 2 is a hydraulic circuit diagram illustrating a hydraulic system for construction machinery in accordance with example embodiments. FIG. 3 is a block diagram illustrating a determiner configured to determine a failure in a regeneration device of the hydraulic system in FIG. 2.

Referring to FIGS. 1 to 3, construction machinery 10 may include a lower travelling body 20, an upper swing body 30 mounted rotatably on the lower travelling body 20, and a cabin 50 and a front work apparatus 60 installed in the upper swing body 30.

The lower travelling body 20 may support the upper swing body 30, and may use a driving force generated by an engine 100 to travel the construction machinery 10 such as an excavator. The lower travelling body 20 may be a crawler type travelling body having a track shoe assembly. Alternatively, the lower travelling body 20 may be a wheel type travelling body including driving wheels. The upper swing body 30 may include an upper frame 32 as a base, and may rotate on a plane parallel with a ground to determine a working direction. The cabin 50 may be installed in a left front portion of the upper frame 32, and the front work apparatus 60 may be installed in a front body of the upper frame 32.

The front work apparatus 60 may include a boom 70, an arm 80 and a bucket 90. A boom cylinder 72 may be installed between the boom 70 and the upper frame 32 to control a movement of the boom 70. An arm cylinder 82 may be installed between the arm 80 and the boom 70 to control a movement of the arm 80. A bucket cylinder 92 may be installed between the bucket 90 and the arm 80 to control a movement of the bucket 90. As the boom cylinder 72, the arm cylinder 82 and the bucket cylinder 92 expand or contract, the boom 70, the arm 80 and the bucket 90 may implement various movements, so that the front work apparatus 60 may perform various works. The boom cylinder 72, the arm cylinder 82 and the bucket cylinder 92 may expand or contract by a hydraulic oil supplied from a hydraulic pump 200, 202.

In addition, an energy regeneration system may be provided to regenerate boom energy which is wasted from the boom cylinder 72 when the boom 70 is lowered. The energy regeneration system may include a regeneration valve unit 400 having a plurality of valves.

The energy regeneration system may accumulate the hydraulic oil, which is discharged from the boom cylinder 72 when the boom 70 is lowered, in an accumulator 500 or to supply the hydraulic oil to a hydraulic motor 510 to thereby assist an output of the engine, as described later.

As illustrated in FIG. 2, a hydraulic system of construction machinery in accordance with example embodiments, may include at least one hydraulic pump 200, 202 connected to the engine 100, at least one actuator 72, 82, 92 configured to operate the front work apparatus, a main control valve (MCV) 300 installed between the hydraulic pump and the actuator to control an operation of the actuator, a regeneration device configured to regenerate energy of the front work apparatus, and a control unit 600 configured to control an operation of the front work apparatus.

In example embodiments, the engine 100 may include a diesel engine as a driving source for a construction machine, for example, excavator. At least one hydraulic pump 200, 202 may be connected to the engine 100 through a power take off (PTO). Although it is not illustrated in the figures, a pilot pump or additional hydraulic pumps may be connected to the engine 100. Accordingly, a power of the engine 100 may be transferred to the hydraulic pump 200, 202 and the pilot pump.

The hydraulic pump 200, 202 may be connected to the main control valve 300 through a hydraulic line 210. The main control valve 300 may supply a hydraulic oil which is discharged from the hydraulic pump 200, 202, to the actuator such as the boom cylinder 72, arm cylinder 82, the bucket cylinder 92, etc.

The main control valve 300 may be connected to a plurality of actuators including the boom cylinder 72, the arm cylinder 82 and the bucket cylinder 92 through a high-pressure hydraulic line 220, respectively. Accordingly, the actuators such as the boom cylinder, the arm cylinder and the bucket cylinder may be driven by the hydraulic oil discharged from the hydraulic pump 200, 202.

For example, a boom control spool 310 may be connected to a boom head chamber 72*a* and a boom rod chamber 72*b* by a boom head hydraulic line 222 and a boom rod hydraulic line 224 respectively. Accordingly, the boom control spool 310 may be switched to selectively supply the hydraulic oil discharged from the hydraulic pump 200 to the boom head chamber 72*a* and the boom rod chamber 72*b*.

The hydraulic oil which drives the actuator may return to a drain tank T through a return hydraulic line 212. In example embodiments, when the boom is lowered, the hydraulic oil from the boom head chamber 72*a* may be drained to the drain tank T through the boom head hydraulic line 222 via the boom control spool 310. When the boom is raised, the hydraulic oil from the boom rod chamber 72*b* may be drained to the drain tank T through the boom rod hydraulic line 224 via the boom control spool 310.

In example embodiments, the hydraulic system for construction machinery may include the regeneration valve unit 400 which is installed in a hydraulic regeneration line 230 connected to the boom head chamber 72*a* to control a supply of the hydraulic oil to the regeneration device. The regeneration valve unit may include a discharge amount control valve 410, a check valve 420 and an auxiliary flow control valve 430. However, it may not be limited thereto, and the regeneration valve unit may have various valves adapted for the energy regeneration system.

The hydraulic regeneration line 230 may be connected to the boom head chamber 72*a*. A hydraulic line from a boom lock valve 76 may branch into the boom head hydraulic line 222 and the hydraulic regeneration line 230. The discharge amount control valve 410 may be installed in the hydraulic regeneration line 230 to control an amount of the hydraulic oil flowing through the hydraulic regeneration line 230. The check valve 420 for holding the boom 70 may be installed in the hydraulic regeneration line 230 in front of the discharge amount control valve 410 to selectively open and close the hydraulic regeneration line 230. An opening/closing valve 430 may be installed in a connection line 240 which connects the hydraulic regeneration line 230 to the boom rod chamber 72*b*, to selectively supply a portion of the hydraulic oil discharged through the hydraulic regeneration line 230 to the boom rod chamber 72*b* of the boom cylinder 72.

In example embodiments, the control unit 600 may output a pilot signal pressure to the regeneration valve unit to control supplying of the hydraulic oil to the regeneration device through the hydraulic regeneration line 230. The control unit 600 may include a controller to apply electrical signals and first to third control valves to output pilot signal pressures corresponding to the applied electrical signals.

In particular, the first control valve may apply a pilot signal pressure corresponding to an electrical signal applied from the controller, to the discharge amount control valve 410. The first control valve may include an electro proportional pressure reducing valve (EPPRV). The pilot signal pressure outputted from the first control valve may be supplied to a left port of the discharge amount control valve 410 to switch to the right direction in FIG. 2, to thereby open the hydraulic regeneration line 230. An opening area of the discharge amount control valve 410 through which the hydraulic oil passes may be changed according to a position of a control spool. Accordingly, the discharge amount control valve 410 may control opening/closing of the hydraulic regeneration line 230 or the amount of the hydraulic oil passing through the hydraulic regeneration line 230.

The second control valve may apply a pilot signal pressure corresponding to an electrical signal applied from the controller, to the check valve 420. The first control valve may include an electro proportional pressure reducing valve (EPPRV). The pilot signal pressure outputted from the second control valve may be supplied to the check valve 420 to open the hydraulic regeneration line 230. The check valve 420 may be a pilot-operated check valve which is held open by the pilot signal pressure. Alternatively, the second control valve may be a solenoid valve. In this case, the check valve 420 may be opened/closed by ON/OFF signal of the solenoid valve.

The third control valve may apply a pilot signal pressure corresponding to an electrical signal applied from the controller, to the opening/closing valve 430. The third control valve may include an electro proportional pressure reducing valve (EPPRV). The pilot signal pressure outputted from the third control valve may be supplied to a left port of the opening/closing valve 430 to switch to the right direction in FIG. 2, to thereby open the connection line 240. Thus, as the boom rod chamber 72*b* is connected to the hydraulic regeneration line 230 through the connection line 240, insufficient flow rates due to an area difference between the head side and the rod side of the boom cylinder when the boom is lowered, may be supplied to the boom rod chamber 72*b* of the boom cylinder 72.

In example embodiments, the regeneration device may regenerate energy using the high-pressure hydraulic oil discharged from the boom head chamber 72*a* of the boom cylinder 72. The regeneration device may include an accumulator 500 and a hydraulic motor 510. A distal end of the hydraulic regeneration line 230 may branch to be connected to the accumulator 500 and the hydraulic motor 510.

The accumulator 500 may accumulate the high-pressure hydraulic oil which is discharged from the boom head chamber 72*a* of the boom cylinder 72 when the boom is lowered. An opening/closing valve 502 may be installed in the hydraulic regeneration line 230 connected to the accumulator 500 to control supplying/discharging of the hydraulic oil to/from the accumulator 500.

In particular, the control unit may include a fourth control valve to output a pilot signal pressure corresponding to an applied electrical signal, and the fourth control valve may output the pilot signal pressure to the opening/closing valve 502. The fourth control valve may include an electro proportional pressure reducing valve (EPPRV). The opening/closing valve 502 may be switched by the pilot signal pressure outputted from the fourth control valve, to control supplying/discharging of the hydraulic oil to/from the accumulator 500.

The hydraulic motor 510 may be connected to a drive axis of the engine 100 to assist driving power of the engine. The hydraulic motor 510 may be connected to the drive axis of the engine 100 through the power take off (PTO) having a predetermined gear ratio.

In example embodiments, the main control valve 300 may include a hydraulic type control valve. The boom control spool 310 may be controlled by a pilot pressure in proportion to a manipulation signal of a manipulation portion 52.

In particular, as an operator manipulates the manipulating portion 52, the manipulation portion 52 may generate a pilot oil, which is discharged from the pilot pump, to have the pilot pressure in proportion to the manipulation signal and may supply the pilot oil to the boom control spool 310 through control lines. Accordingly, the boom control spool 310 may be displaced in proportion to the pilot pressure of the pilot oil, and thus, the hydraulic oil discharge from the hydraulic pump 200 may be supplied to the boom cylinder through the boom control spool 310.

The control unit may include a bypass valve 610 which is provided in the control lines between the manipulation portion 52 and the main control valve 300 to block the control pressure (pilot pressure) from being transferred to the main control valve 300. The bypass valve 610 may include an opening/closing valve.

In this case, the control unit may include a fifth control valve to output a pilot signal pressure corresponding to an applied electrical signal, and the fifth control valve may output the pilot signal pressure to the bypass valve 610. The fifth control valve may include an electro proportional pressure reducing valve (EPPRV). The bypass valve 502 may be switched by the pilot signal pressure outputted from the fifth control valve to open and close the control lines, and thus, the pilot pressure from the manipulation portion 52 may be selectively blocked from being transferred to the boom control spool 310.

As illustrated in FIGS. 2 and 3, in example embodiments, the control unit 600 may include a determiner 620 which receives a pressure of the accumulator 500 detected by a pressure sensor 504 and determines whether or not the hydraulic pump 510 fails when the hydraulic oil accumulated in the accumulator 500 is supplied to the hydraulic pump 510.

In particular, the determiner 620 may include a first calculator 622 to calculate a volume change of the accumulator from the pressure value of the accumulator 500, a second calculator 624 to calculate a flow rate of the hydraulic motor from number of revolution of the hydraulic motor 510, and a comparer 626 to compare the volume change and the flow rate to determine a failure in the hydraulic motor and output a control signal.

Figure 4:
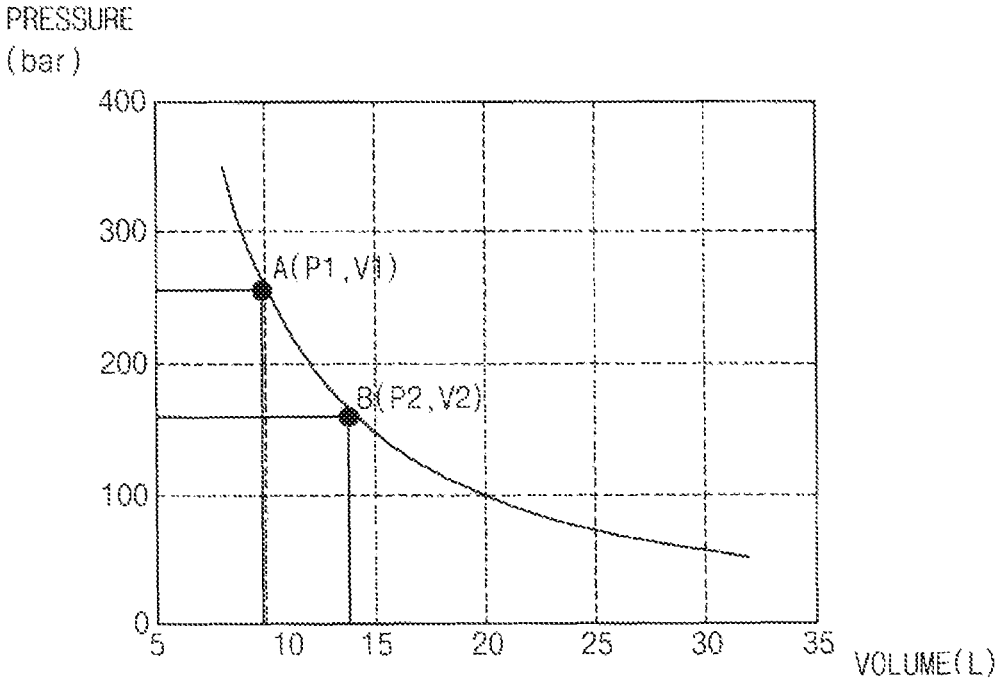
FIG. 4 is a graph illustrating a pressure change of the accumulator when the hydraulic oil accumulated in the accumulator is supplied to the hydraulic motor in FIG. 2.

FIG. 4 is a graph illustrating a pressure change of the accumulator when the hydraulic oil accumulated in the accumulator is supplied to the hydraulic motor in FIG. 2.

Referring to FIG. 4, when the hydraulic oil is supplied from the accumulator 500 to the hydraulic motor 510, a PV curve may represent that state A(t1) moves state B(t2). That is, the pressure of the accumulator 500 may be decreased from P1 to P2 and the volume of a gas portion in the accumulator 500 may be increased from V1 to V2. The pressure P of the accumulator 500 and the volume V of the gas portion may be represented by following equation (1).

$$PV^n = \text{const} \qquad \text{Equation (1)}$$

Here, P is a pressure of the accumulator, V is a volume of a gas portion of the accumulator, and n is polytropic index.

The first calculator 622 may receive a pressure value of the accumulator 500 from the pressure sensor 504 and may calculate the volume of the hydraulic oil discharged from the accumulator 500 using the equation (1).

The hydraulic oil discharged from the accumulator 500 may be supplied to the hydraulic motor 510 to generate torque and then may be drained to a drain tank T. The hydraulic motor 510 may be a variable displacement hydraulic motor. Accordingly, a swash plate angle of the hydraulic motor 510 may be controlled and an output torque of the hydraulic motor 510 may be controlled.

The second calculator 624 may calculate a flow rate of the hydraulic oil discharged through the hydraulic motor 510. The flow rate Q of the hydraulic oil flowing through the hydraulic motor 510 may be represented by following equation (2).

$$\text{Qmotor_ideal} = \omega\text{motor} \times \theta\text{max} \times \left(\frac{\theta\text{cmd_current}}{\theta\text{cmd_max}}\right) \quad \text{Equation (2)}$$

Here, Qmotor_ideal is a flow rate of the hydraulic motor, ωmotor is number of revolution of the hydraulic motor, θmax is a maximum volume of the hydraulic motor, θcmd_current is a current command value of the swash plate of the hydraulic motor, and θcmd_max is a maximum command value of the swash plate of the hydraulic motor.

Because the hydraulic motor 510 is connected to the drive axis of the engine 100 through the power take off (PTO) having a predetermined gear ratio, the number of revolution of the hydraulic motor may be represented by following equation (3).

$$w\text{motor} = w\text{engine} \times G \quad \text{Equation (3)}$$

Here, wmotor is number of revolution of the hydraulic motor, wengine is engine rpm, G is PTO gear ratio.

The second calculator 624 may receive engine rpm information from an engine ECU to calculate the number of revolution of the hydraulic motor 510 using the equation (3) and may calculate the flow rate Q of the hydraulic oil flowing through the hydraulic motor 510.

The comparer 626 may receive and compare the volume value of the hydraulic oil discharged from the accumulator and the flow rate value of the hydraulic oil flowing through the hydraulic motor to determine whether or not the hydraulic motor fails and output a control signal.

When the hydraulic motor 510 operates normally, the calculated volume change of the accumulator and the calculated flow rate of the hydraulic motor may be identical to each other. When the hydraulic motor 510 operates abnormally, the calculated volume change of the accumulator and the calculated flow rate of the hydraulic motor may not be identical to each other. Accordingly, the volume change due to the pressure change in the accumulator and the theoretical flow rate value of the hydraulic motor may be calculated to determine whether or not the hydraulic motor fails.

When it is determined that the hydraulic motor fails, the comparer 626 may output a control signal such that the hydraulic oil discharged from the boom cylinder 72 may be blocked from being supplied to the regeneration device through the hydraulic regeneration line 230 and the pilot oil from the manipulation portion 52 may be supplied to the main control valve 300.

In particular, when it is determined that the hydraulic motor fails, if an operator inputs a boom down signal through the manipulation portion 52, the control unit may close the hydraulic regeneration line 230 to block the hydraulic oil from being supplied to the regeneration device through the hydraulic regeneration line 230. Additionally, the control unit may open the bypass valve 610 such that the pilot pressure from the manipulation portion 52 may be transferred to the boom control spool 310 of the main control valve 300.

Accordingly, the hydraulic oil from the boom head chamber 72*a* of the boom cylinder 72 may be supplied to the boom control spool 310 of the main control valve 300. The hydraulic oil discharged from the boom cylinder 72 may be drained to the drain tank T through the main control valve 300. On the other hand, the hydraulic regeneration line 230 may be closed such that the hydraulic oil from the boom head chamber 72*a* may not be supplied to the regeneration device.

When it is determined that the hydraulic motor operates normally, the comparer 626 may output a control signal such that the hydraulic oil discharged from the boom cylinder 72 may be supplied to the regeneration device through the hydraulic regeneration line 230 and the pilot oil from the manipulation portion 52 may be blocked from being supplied to the main control valve 300.

In particular, when it is determined that the hydraulic motor does not fail, if an operator inputs a boom down signal through the manipulation portion 52, the control unit may apply a pilot signal pressure to the discharge amount control valve 410, the check valve 420 and the opening/closing valve 430 to open the hydraulic regeneration line 230. Additionally, the control unit may apply a pilot signal pressure to the bypass valve 610 such that the pilot pressure from the manipulation portion 52 may be blocked from being applied to the boom control spool 310 of the main control valve 300.

Accordingly, the hydraulic oil from the boom head chamber 72*a* of the boom cylinder 72 may be supplied to the regeneration device through the hydraulic regeneration line 230 to regenerate potential energy of the boom. On the other hand, the pilot pressure from the manipulation portion 52 may not be supplied to the boom control spool 310 of the main control valve 300 by the bypass valve 610, and accordingly, the boom control spool 310 may not be switched by the boom down signal and the hydraulic oil discharged from the boom head chamber 72*a* may not be discharged through the boom head hydraulic line 222. Thus, the hydraulic oil discharged from the boom cylinder 72 may be drained to the drain tank T through the hydraulic motor 510 of the regeneration device.

As mentioned above, the hydraulic control apparatus of construction machinery may calculate the volume change due to the pressure change in the accumulator 500 and the theoretical flow rate value of the hydraulic motor 510 to determine whether or not the hydraulic motor 510 fails.

Accordingly, because an extra swash plate sensor for detecting a failure in the hydraulic motor is not needed, a design modification of the hydraulic motor may not be required, and whether or not the hydraulic motor fails may be determined using the above software calculation. When it is determined that the hydraulic motor fails, the boom energy regeneration device may discontinue to operate and an operator may be informed of an alarm signal in order for rapid repairs.

Figure 5:
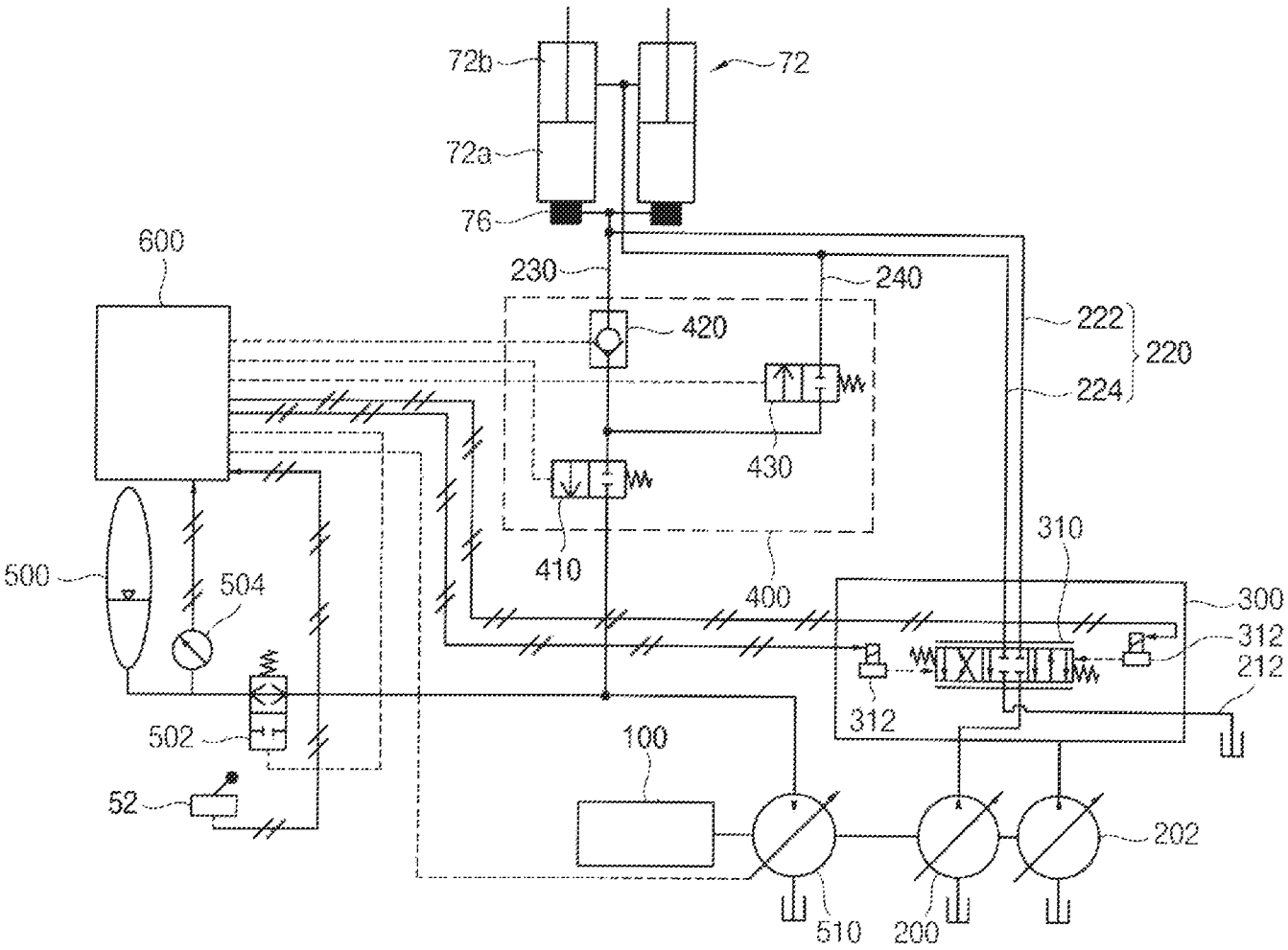
FIG. 5 is a hydraulic circuit diagram illustrating a hydraulic system for construction machinery in accordance with example embodiments.

FIG. 5 is a hydraulic circuit diagram illustrating a hydraulic system for construction machinery in accordance with example embodiments. The hydraulic system for construction machinery may be substantially the same as or similar to the hydraulic system for construction machinery as described with reference to FIGS. 1 to 3, except that the hydraulic system includes an electro-hydraulic control valve. Thus, same reference numerals will be used to refer to the same or like elements and any further repetitive explanation concerning the above elements will be omitted.

Referring to FIG. 5, in example embodiments, a main control valve 300 may include an electro-hydraulic control valve. A boom control spool 310 may be controlled by an electro proportional pressure reducing valve (EPPRV) which outputs a secondary pressure (pilot pressure) in proportion to an external pressure command signal (control current signal).

In particular, a control unit may receive an electrical signal in proportion to a manipulation amount of an operator from a manipulation portion 52, and may output the pressure command signal (control current signal) to the electro proportional pressure reducing valves 312 corresponding to the electrical signal. The electro proportional pressure reducing valves 312 may output the secondary pressure in proportion to the pressure command signal to the boom control spool 310 to control the boom control spool with the electrical signal.

A pair of the electro proportional pressure reducing valves 312 may be provided in both sides of the boom control spool 310. The electro proportional pressure reducing valve may supply a secondary pressure in proportion to the pressure command signal to the boom control spool such that the boom control spool may be displaced in proportion to the secondary pressure. Thus, a hydraulic oil from a hydraulic pump 200 may be supplied to a boom cylinder 72 through the boom control spool 310.

The control unit may include a controller to apply a pressure command signal (for example, control current signal) as an electrical signal to the electro proportional pressure reducing valves 312 of the main control valve 300. The controller may selectively apply the pressure command signal corresponding to the electrical signal applied from the manipulation portion 52, to the electro proportional pressure reducing valves 312 of the main control valve 300. For example, the controller may not apply the pressure command signal to the electro proportional pressure reducing valves 312, such that a control pressure (pilot pressure) from the manipulation portion 52 may be blocked from being transferred to the main control valve 300.

When it is determined that a hydraulic pump fails, a comparer 626 may output a control signal such that the hydraulic oil discharged from the boom cylinder 72 may be blocked from being supplied to a regeneration device through a hydraulic regeneration line 230 and the pilot pressure from the manipulation portion 52 may be supplied to the main control valve 300.

In particular, when it is determined that the hydraulic motor fails, if an operator inputs a boom down signal through the manipulation portion 52, the control unit may close the hydraulic regeneration line 230 to block the hydraulic oil from being supplied to the regeneration device through the hydraulic regeneration line 230. Additionally, the control unit may apply the pressure command signal to the electro proportional pressure reducing valves 312 such that the pilot pressure from the manipulation portion 52 may be transferred to the boom control spool 310 of the main control valve 300.

Accordingly, the hydraulic oil from the boom head chamber 72*a* of the boom cylinder 72 may be supplied to the boom control spool 310 of the main control valve 300. The hydraulic oil discharged from the boom cylinder 72 may be drained to the drain tank T through the main control valve 300. On the other hand, the hydraulic regeneration line 230 may be closed such that the hydraulic oil from the boom head chamber 72*a* may not be supplied to the regeneration device.

When it is determined that the hydraulic motor operates normally, the comparer 626 may output a control signal such that the hydraulic oil discharged from the boom cylinder 72 may be supplied to the regeneration device through the hydraulic regeneration line 230 and the pilot oil from the manipulation portion 52 may be blocked from being supplied to the main control valve 300.

In particular, when it is determined that the hydraulic motor does not fail, if an operator inputs a boom down signal through the manipulation portion 52, the control unit may apply a pilot signal pressure to a discharge amount control valve 410, a check valve 420 and a opening/closing valve 430 to open the hydraulic regeneration line 230. Additionally, the control unit may not apply the pressure command signal to the electro proportional pressure reducing valves 312 such that the pilot pressure from the manipulation portion 52 may be blocked from being applied to the boom control spool 310 of the main control valve 300.

Accordingly, the hydraulic oil from the boom head chamber 72*a* of the boom cylinder 72 may be supplied to the regeneration device through the hydraulic regeneration line 230 to regenerate potential energy of the boom. On the other hand, the boom control spool 310 of the main control valve 300 may not be switched such that the hydraulic oil discharged from the boom head chamber 72*a* may not be discharged through the boom head hydraulic line 222. In the boom down regeneration mode, the hydraulic oil may be drained to the drain tank T through the hydraulic motor of the regeneration device.

Hereinafter, a hydraulic control method for construction machinery using the hydraulic system in FIGS. 2 and 5 will be explained.

Figure 6:
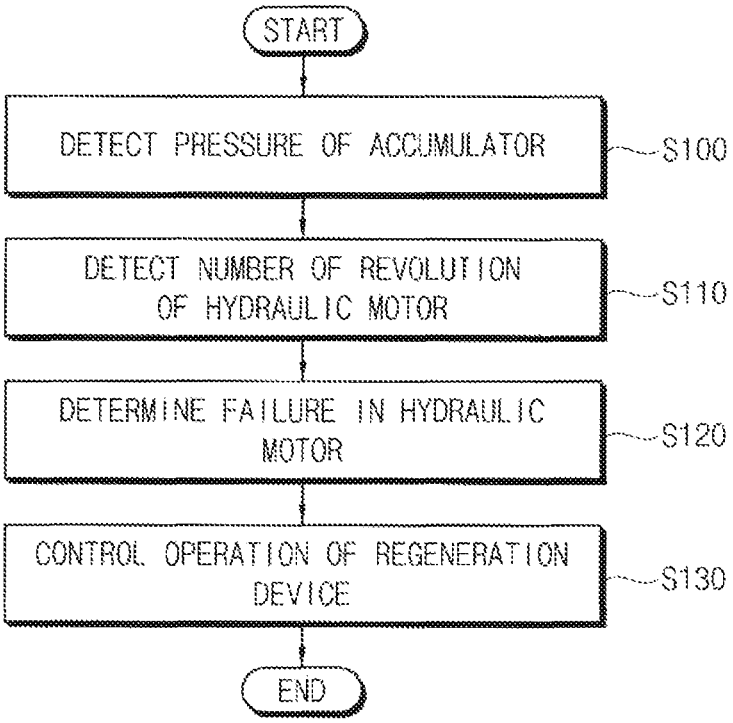
FIG. 6 is a flow chart illustrating a hydraulic control method of construction machinery in accordance with example embodiments.

FIG. 6 is a flow chart illustrating a hydraulic control method of construction machinery in accordance with example embodiments.

Referring to FIGS. 2, 5 and 6, first, a hydraulic oil discharged from a boom cylinder 72 of construction machinery may be accumulated in an accumulator 500, and then, the hydraulic oil accumulated in the accumulator 500 may be supplied to a hydraulic motor 510.

In example embodiments, a regeneration device including the accumulator 500 and the hydraulic motor 510 may regenerate energy using the high-pressure hydraulic oil discharged from a boom head chamber 72*a* of the boom cylinder 72 when a boom 70 is lowered.

The accumulator 500 may accumulate the high-pressure hydraulic oil which is discharged from the boom head chamber 72*a* of the boom cylinder 72 when the boom is lowered. The hydraulic motor 510 may be connected to the accumulator 500. The hydraulic motor 510 may be driven by the hydraulic oil accumulated in the accumulator 500. The hydraulic motor 510 may be connected to a drive axis of an engine 100 to assist an output power of the engine, thereby providing a rotational force to a hydraulic pump 200, 202.

When the hydraulic oil accumulated in the accumulator 500 is supplied to the hydraulic motor 510, a pressure of the accumulator 500 may be detected to calculate a volume change of the accumulator 500 and number of revolution of the hydraulic motor 510 may be detected to calculate a flow rate of the hydraulic oil flowing through the hydraulic motor 510 (S100, S110).

In example embodiments, a first calculator 622 may receive a pressure value of the accumulator 500 from a pressure sensor 504 and may calculate the volume of the hydraulic oil discharged from the accumulator 500. A second calculator 624 may receive engine rpm information from an engine ECU to calculate the number of revolution of the hydraulic motor 510 and may calculate the flow rate of the hydraulic oil flowing through the hydraulic motor 510.

Then, the volume value of the hydraulic oil discharged from the accumulator and the flow rate value of the hydraulic oil flowing through the hydraulic motor may be compared to determine whether or not the hydraulic motor 510 fails and an operation of the regeneration device may be controlled (S120, S130).

When the hydraulic pump 510 operates normally, the calculated volume change of the accumulator and the calculated flow rate of the hydraulic motor may be identical to each other. When the hydraulic motor 510 operates abnormally, the calculated volume change of the accumulator and the calculated flow rate of the hydraulic motor may not be identical to each other. Accordingly, the calculated volume change due to the pressure change in the accumulator and the theoretical flow rate value of the hydraulic motor may be calculated to determine whether or not the hydraulic motor fails.

When it is determined that the hydraulic motor fails, the hydraulic oil discharged from the boom cylinder 72 may be blocked from being supplied to the regeneration device through a hydraulic regeneration line 230 and a pilot oil from a manipulation portion 52 may be supplied to a main control valve 300.

Accordingly, the hydraulic oil from a boom head chamber 72*a* of the boom cylinder 72 may be supplied to a boom control spool 310 of the main control valve 300. The hydraulic oil discharged from the boom cylinder 72 may be drained to the drain tank T through the main control valve 300. On the other hand, the hydraulic regeneration line 230 may be closed such that the hydraulic oil from the boom head chamber 72*a* may not be supplied to the regeneration device.

When it is determined that the hydraulic motor operates normally, the hydraulic oil discharged from the boom cylinder 72 may be supplied to the regeneration device through the hydraulic regeneration line 230 and the pilot oil from the manipulation portion 52 may be blocked from being supplied to the main control valve 300.

Accordingly, the hydraulic oil from the boom head chamber 72*a* of the boom cylinder 72 may be supplied to the regeneration device through the hydraulic regeneration line 230 to regenerate potential energy of the boom.

The present invention has been explained with reference to preferable embodiments, however, those skilled in the art may understand that the present invention may be modified or changed without being deviated from the concept and the scope of the present invention disclosed in the following claims.

THE DESCRIPTION OF THE REFERENCE NUMERALS

10: construction machinery 20: lower travelling body
30: upper swing body 32: upper frame
40: counter weight 50: cabin
52: manipulation portion 60: work apparatus
70: boom 72: boom cylinder
72*a*: boom head chamber 72*b*: boom rod chamber
80: arm 82: arm cylinder
90: bucket 92: bucket cylinder
100: engine 200, 202: hydraulic pump
210: hydraulic line 212: return hydraulic line
220: high-pressure hydraulic line 222: boom head hydraulic line
224: boom rod hydraulic line 230: hydraulic regeneration line
300: main control valve 310: boom control spool
312: electro proportional pressure reducing valve 400: regeneration valve unit
410: discharge amount control valve 420: check valve
430: opening/closing valve 500: accumulator
502: opening/closing valve 504: pressure sensor
510: hydraulic motor 600: control unit
610: bypass valve 620: determiner
622: first calculator 624: second calculator
626: comparer

The invention claimed is:

1. A hydraulic control apparatus for construction machinery comprising:

an accumulator to accumulate a high-pressure hydraulic oil discharged from a boom cylinder for driving a boom of the construction machinery;

a hydraulic pump connected to the accumulator and driven by the high-pressure hydraulic oil;

a pressure sensor configured to detect a pressure of the accumulator; and a control unit connected to the accumulator and a hydraulic motor and configured to control operations of the accumulator and the hydraulic motor, and having a determiner that receives a pressure value of the accumulator and a number of revolution of the hydraulic motor to determine whether or not the hydraulic motor fails when the hydraulic oil accumulated in the accumulator is supplied to the hydraulic motor.

2. The hydraulic control apparatus for construction machinery of claim 1, wherein the determiner comprises a first calculator to calculate a volume change of the accumulator from the pressure value of the accumulator;

a second calculator to calculate a flow rate of the hydraulic oil flowing through the hydraulic motor from the number of revolution of the hydraulic motor; and a comparer to compare the volume change and the flow rate to determine a failure in the hydraulic motor and output a control signal.

3. The hydraulic control apparatus for construction machinery of claim 1, wherein the hydraulic motor includes a variable displacement hydraulic motor.

4. The hydraulic control apparatus for construction machinery of claim 3, wherein when it is determined that the hydraulic motor fails, the control unit controls such that the hydraulic oil discharged from the boom cylinder is blocked from being supplied to the hydraulic motor and a pilot pressure from a manipulation portion is supplied to a main control valve.

5. The hydraulic control apparatus for construction machinery of claim 4, wherein the hydraulic oil discharged from a boom head chamber of the boom cylinder is drained to a drain tank through the main control valve.

6. The hydraulic control apparatus for construction machinery of claim 1, wherein when it is determined that the hydraulic motor operates normally, the control unit controls such that a pilot pressure from a manipulation portion is blocked from being transferred to a main control valve.

7. The hydraulic control apparatus for construction machinery of claim 6, further comprising a bypass valve provided between the manipulation portion and the main control valve to block the pilot pressure from being transferred to the main control valve.

8. The hydraulic control apparatus for construction machinery of claim 1, wherein the accumulator and the hydraulic motor are connected to a boom head chamber of the boom cylinder through a hydraulic regeneration line.

9. The hydraulic control apparatus for construction machinery of claim 8, further comprising a regeneration valve unit installed in the hydraulic regeneration line, wherein the regeneration valve unit includes a discharge amount control valve to control an amount of the hydraulic oil flowing through the hydraulic regeneration line.

10. The hydraulic control apparatus for construction machinery of claim 1, wherein the hydraulic motor is connected to a drive axis of an engine to provide a rotational force to a hydraulic pump that supplies the hydraulic oil to the boom cylinder.

11. A hydraulic control method for construction machinery, comprising:

supplying a hydraulic oil accumulated in an accumulator to a hydraulic motor so as to regenerate energy of the hydraulic oil discharged from a boom cylinder of the construction machinery;

calculating a volume change of the accumulator and a flow rate of the hydraulic oil flowing through the hydraulic motor; and comparing the volume change and the flow rate to determine whether or not the hydraulic motor fails.

12. The hydraulic control method for construction machinery of claim 11, wherein calculating the volume change of the accumulator and the flow rate of the hydraulic oil flowing through the hydraulic motor comprises detecting a pressure of the accumulator to calculate the volume change of the accumulator; and calculating the flow rate of the hydraulic oil flowing through the hydraulic motor from a number of revolution of the hydraulic motor.

13. The hydraulic control method for construction machinery of claim 11, further comprising when it is determined that the hydraulic motor fails, blocking the hydraulic oil discharged from the boom cylinder from being supplied to the hydraulic motor and supplying a pilot pressure from a manipulation portion to a main control valve.

14. The hydraulic control method for construction machinery of claim 13, further comprising draining the hydraulic oil discharged from a boom head chamber of the boom cylinder to a drain tank through the main control valve.

15. The hydraulic control method for construction machinery of claim 11, further comprising when it is determined that the hydraulic motor operates normally, blocking a pilot pressure from a manipulation portion from being transferred to a main control valve.

16. The hydraulic control method for construction machinery of claim 15, further comprising supplying the hydraulic oil from a boom head chamber of the boom cylinder to the accumulator or the hydraulic motor through a hydraulic regeneration line.

17. The hydraulic control method for construction machinery of claim 11, wherein the hydraulic motor is connected to a drive axis of an engine to provide a rotational force to a hydraulic pump that supplies the hydraulic oil to the boom cylinder.

* * * * *